US006484430B1

(12) United States Patent
Robinson et al.

(10) Patent No.: US 6,484,430 B1
(45) Date of Patent: Nov. 26, 2002

(54) MULTI-LUGGED BOLT CARRIER AND BARREL FOR RIFLES

(75) Inventors: Alexander J. Robinson, Salt Lake City, UT (US); Darin G. Nebeker, Layton, UT (US)

(73) Assignee: ZDF Import/Export, Inc., Salt Lake City, UT (US)

( * ) Notice: Subject to any disclaimer, the term of this patent is extended or adjusted under 35 U.S.C. 154(b) by 0 days.

(21) Appl. No.: 09/493,024

(22) Filed: Jan. 27, 2000

Related U.S. Application Data

(60) Provisional application No. 60/117,482, filed on Jan. 27, 1999.

(51) Int. Cl.[7] ..... F41A 3/26
(52) U.S. Cl. ..... 42/25; 89/188
(58) Field of Search ..... 89/185, 188; 42/25

(56) References Cited

U.S. PATENT DOCUMENTS 3,906,651 A * 9/1975 Vesamaa ..... 42/25
4,615,132 A * 10/1986 Smith ..... 42/25
4,942,802 A * 7/1990 Stoner ..... 89/191.01
5,117,735 A * 6/1992 Flashkes ..... 89/188
5,768,815 A * 6/1998 Casull ..... 42/25
6,019,024 A * 2/2000 Robinson et al. ..... 89/191.01

FOREIGN PATENT DOCUMENTS

CH 298923 * 5/1954 ..... 42/25

* cited by examiner

*Primary Examiner*—Stephen M. Johnson
(74) *Attorney, Agent, or Firm*—Lloyd W. Sadler

(57) ABSTRACT

An improved bolt, bolt carrier and barrel assembly for rifles is described. This invention provides bolt mechanism that has heavier lugs on each side of the extractor to distribute the forces more equally and reliably and thereby reducing firearm failure rate. Moreover, this invention provides a bolt system that is easily adaptable to different ammunition feed devices as well as different ammunition cartridges. This invention further includes a barrel having a barrel extension designed to mate to the symmetrical bolt head lugs of this invention.

4 Claims, 12 Drawing Sheets

MULTI-LUGGED BOLT CARRIER AND BARREL FOR RIFLES

This application claims the benefit of provisional application No. 60/117,482, field Jan. 27, 1999

BACKGROUND OF THE INVENTION

1. Field of the Invention

This invention relates to components for weapon system. More specifically, this invention relates to multi-lugged bolts, bolt carriers, and barrels for rifles.

2. Description of Related Art

A wide variety of bolt, bolt carriers and barrels are well known in the art. Typically such devices have lugs of the same size, regardless of the load bearing on the lugs, and which are evenly spaced around the face of the bolt, with the possible exception of the area required for the extractor. The following well known rifles have multi-lugged bolts and bolt carriers: the Johnson Model 1941 rifle and machine gun developed by Melvin Johnson; the M16/AR15 and Stoner 63 Weapons System developed by Eugene Stoner; the AR18 Rifle developed by Armalite; the Daewoo military and Sporting Rifles developed by the Korean company Daewoo; and the Steyer AUG rifle made in Austria. Other similar rifles are well known in the art.

SUMMARY OF THE INVENTION

It is desirable to provide a bolt and bolt carrier for rifles that permits ammunition to be fed from a variety of ammunition feeding devices, such as box magazines, clip magazines and ammunition belts while providing improved fatigue strength during the firing sequence. It is also desirable to provide a bolt and bolt carrier device that can be easily adapted in the field by the operator without the use of special tools to reconfigure the gun to fire a variety of cartridges, including but not limited to: 0.223 Rem (5.56×45 mm); 7.62×39 mm; and 5.45×39 mm. It is desirable to provide a bolt carrier that is designed to accept the bolt and to glide over a variety of magazines. In particular, it is desirable to provide a bolt with improved lug strength and failure resistance.

Therefore, it is the general object of this invention to provide an improved bolt and bolt carrier for automatic rifles that is compatible with receiving ammunition from a variety of feeding devices.

It is a further object of this invention to provide an improved bolt and bolt carrier for automatic rifles that can be easily adapted to fire a wide variety of well-known cartridges.

Another object of this invention to provide an improved bolt and bolt carrier for automatic rifles with improved lug strength and durability.

A still further object of this invention to provide an improved bolt and bolt carrier for automatic rifles that has an improved failure rate.

A further object of this invention to provide an improved bolt and bolt carrier for automatic rifles that has heavier lugs on each side of the extractor, that are adapted to receive without failure additional loading.

These and other objects of this invention are achieved by the invention as described herein.

DETAILED DESCRIPTION OF THE INVENTION

Figure 1:
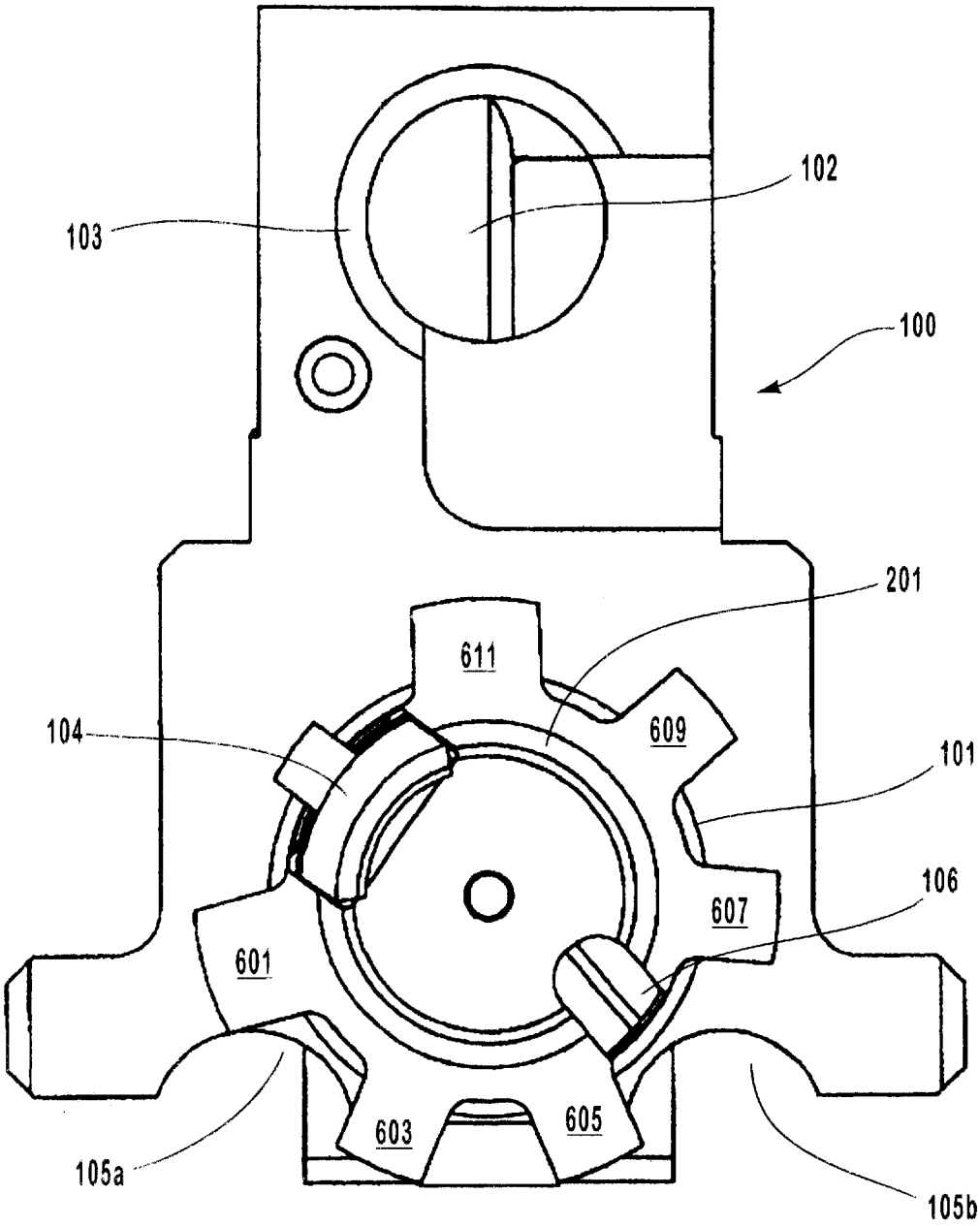
FIG. 1 is a front view of the preferred bolt carrier and bolt of this invention.

Referring now to the figures and particularly to FIG. 1 showing the preferred bolt carrier 100 with the preferred bolt 101 inserted in the bolthole (not shown). The bolt carrier 100 has an operation rod hole 103 with an operation rod catch 102 for receiving and retaining the operation rod. The preferred bolt 101 is provided with six lugs 601, 603, 605, 607, 609, 611 on the bolt head 201. An extractor 104 as well as an ejector slot 106 are provided generally opposite each other on the bolt head 201. Indentations 105*a*,b are provided to permit the bolt carrier 100 to fit to a wide variety of ammunition magazines.

Figure 2:
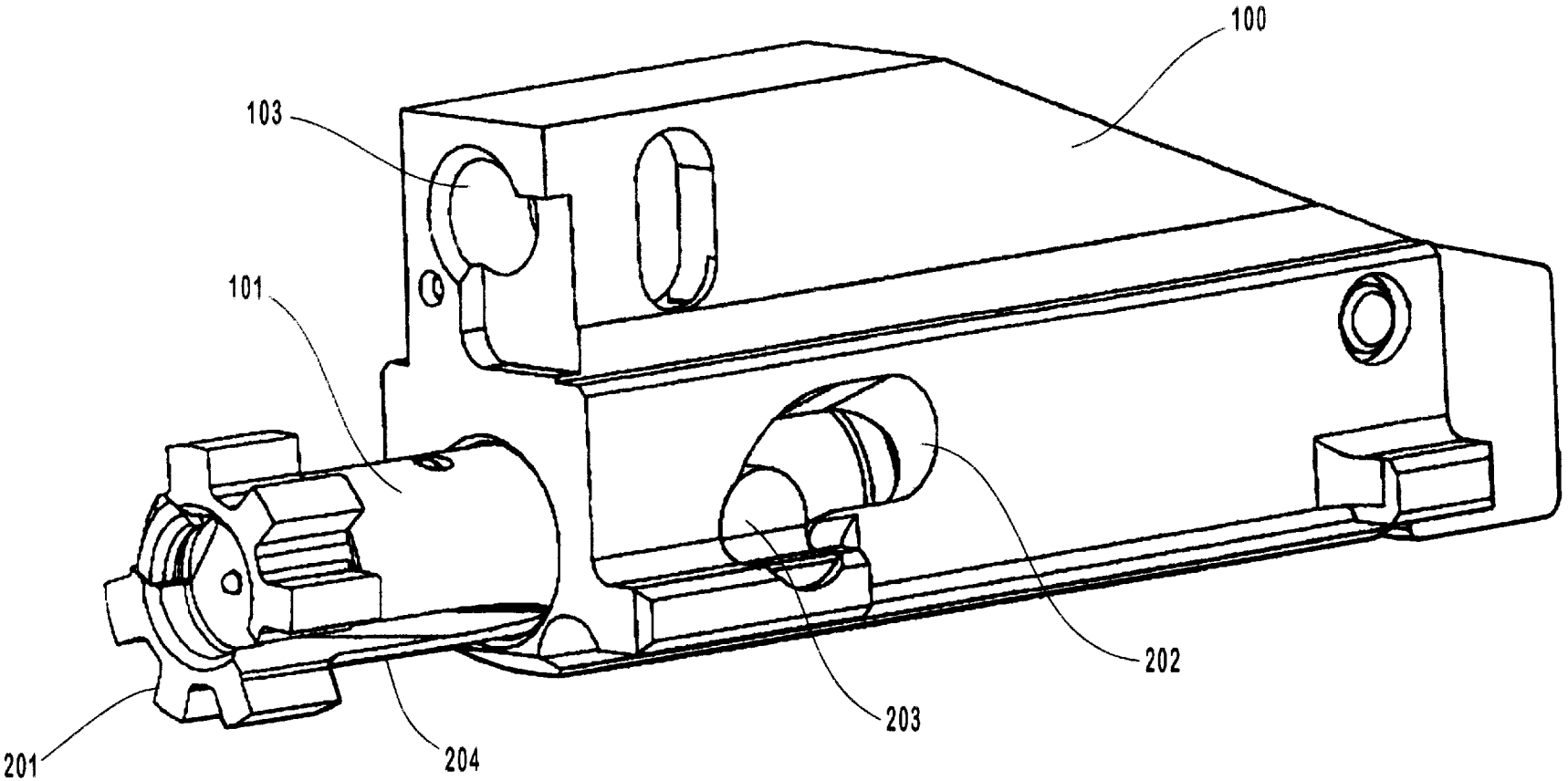
FIG. 2 is a left side view of the preferred bolt carrier and bolt of this invention.

FIG. 2 shows the left side view of the preferred bolt carrier 100 and bolt 101 of this invention. The bolt head 201 is shown fixed to the end of the bolt shaft 204. A cam slot 202 is provided on the left side of the bolt carrier 100, through which a cam pin 203 can be seen. The operation rod hole 103 is also shown in perspective view.

Figure 3:
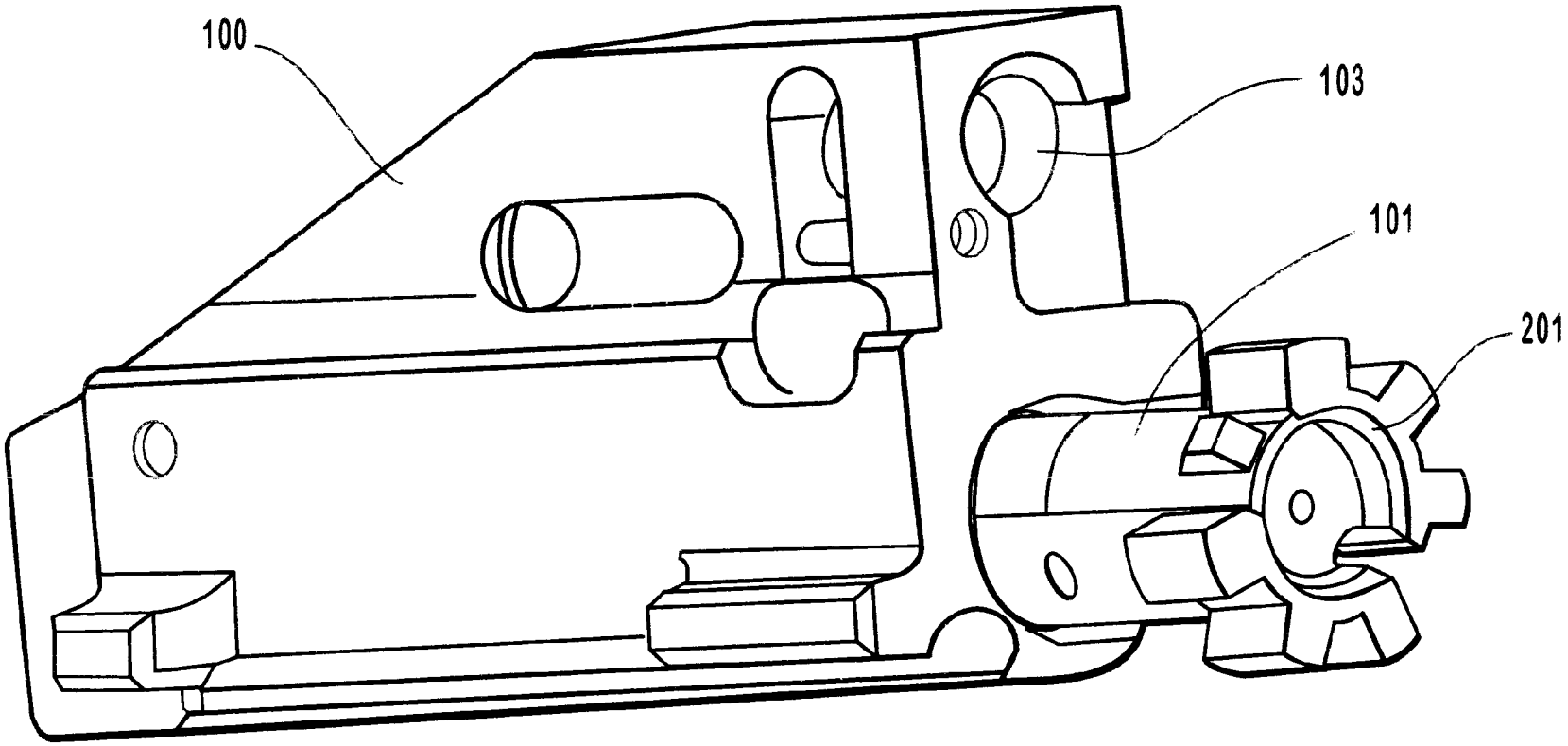
FIG. 3 is a right side view of the preferred bolt carrier and bolt of this invention.

FIG. 3 shows the right side view of the preferred bolt carrier 100 of this invention. This view provides additional detail as to the bolt lug head 201 of this invention.

Figure 4:
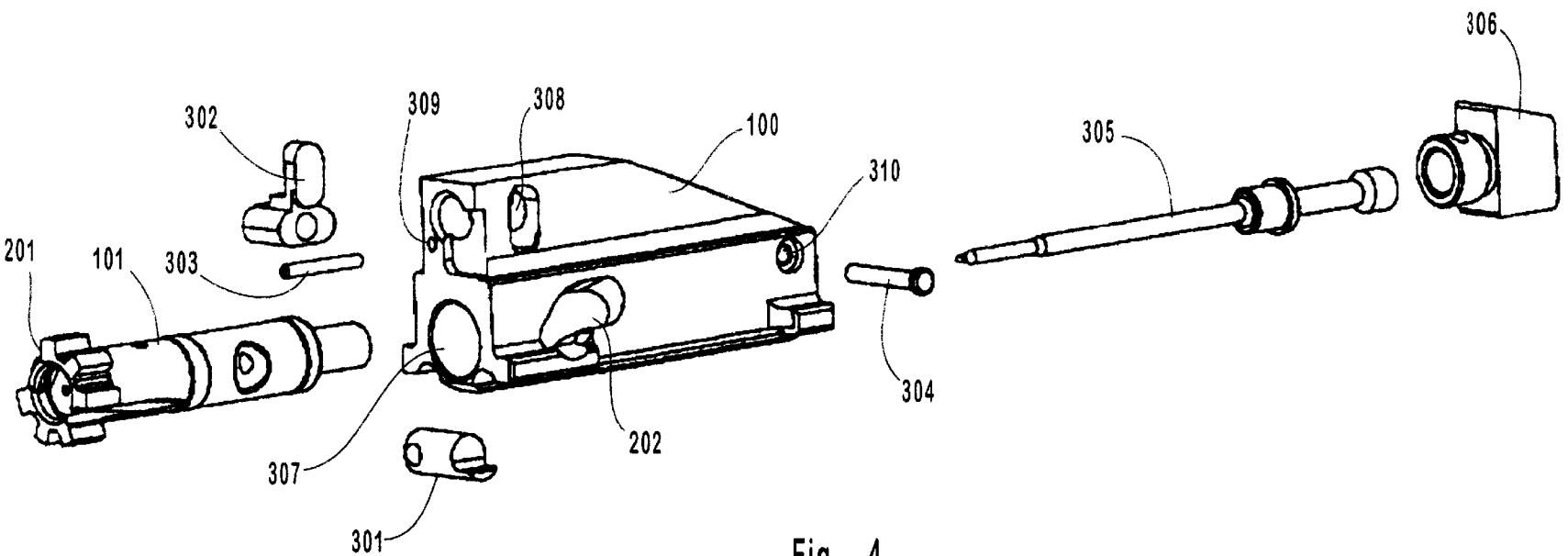
FIG. 4 is a disassembled view of the major components of and related to the preferred bolt carrier and bolt of this invention.

FIG. 4 shows the major components and related components of the preferred bolt carrier 100 and bolt 101 of this invention in disassembled but close proximity to each other. The bolt 101 is shown with the bolt head 201 extended away from the bolthole 307 in the bolt carrier 100. A cam 301 is shown adapted to mechanically interact with the bolt 101 through the cam slot 202. An operation rod catch 302 is provided, which is insertable into the catch opening 308 in the bolt carrier 100. A bolt catch retension pin 303 is provided to hold the operation rod catch 302 in place by insertion into the pin hole 309 after inserting the operation rod catch 302 in the bolt carrier 100. A firing pin 305 is provided with a carrier end 306, both of which are adapted to be held in place within the bolt carrier 100 by a carrier end pin 304 which is inserted into an carrier pin hole 310, after insertion of the firing pin 305 and carrier end 306, thereby holding each in place.

Figure 5:
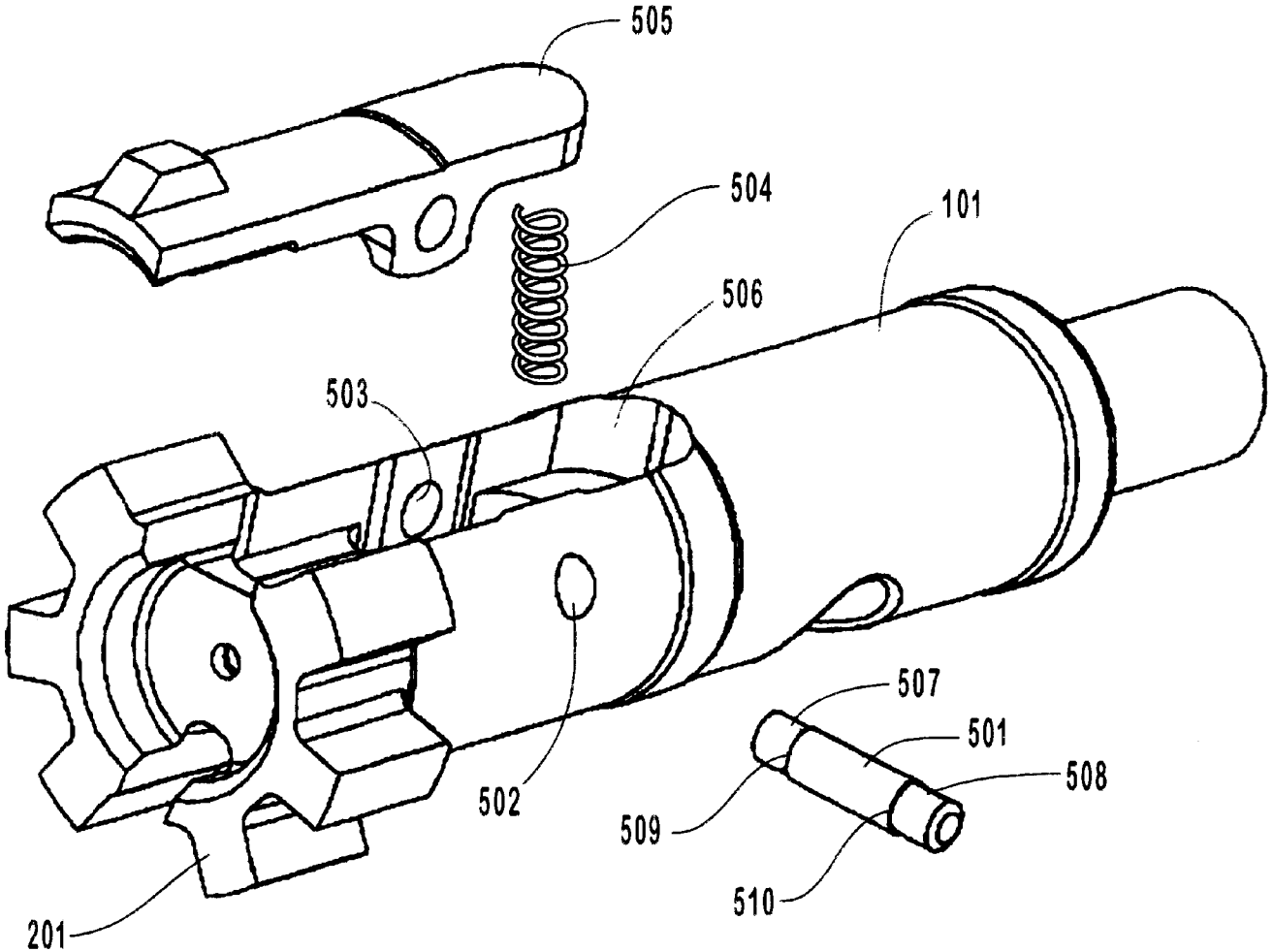
FIG. 5 is a detailed drawing of the preferred bolt of this invention showing the preferred component parts.

FIG. 5 shows a detailed perspective view of the preferred bolt 101 of this invention. An extractor 505 is fixed to the bolt 101 by an extractor pin 501, which is adapted to be positioned inside 506 the bolt 101 with each end 507 and 508 pressed through pin holes 503 and 502 respectively. A spring 504 is provided to give tension to the extractor 505, while simultaneously holding the extractor pin 501 in place. The extractor pin 501 is stepped 509 and 510 to keep the extractor pin 501 in place.

Figure 6:
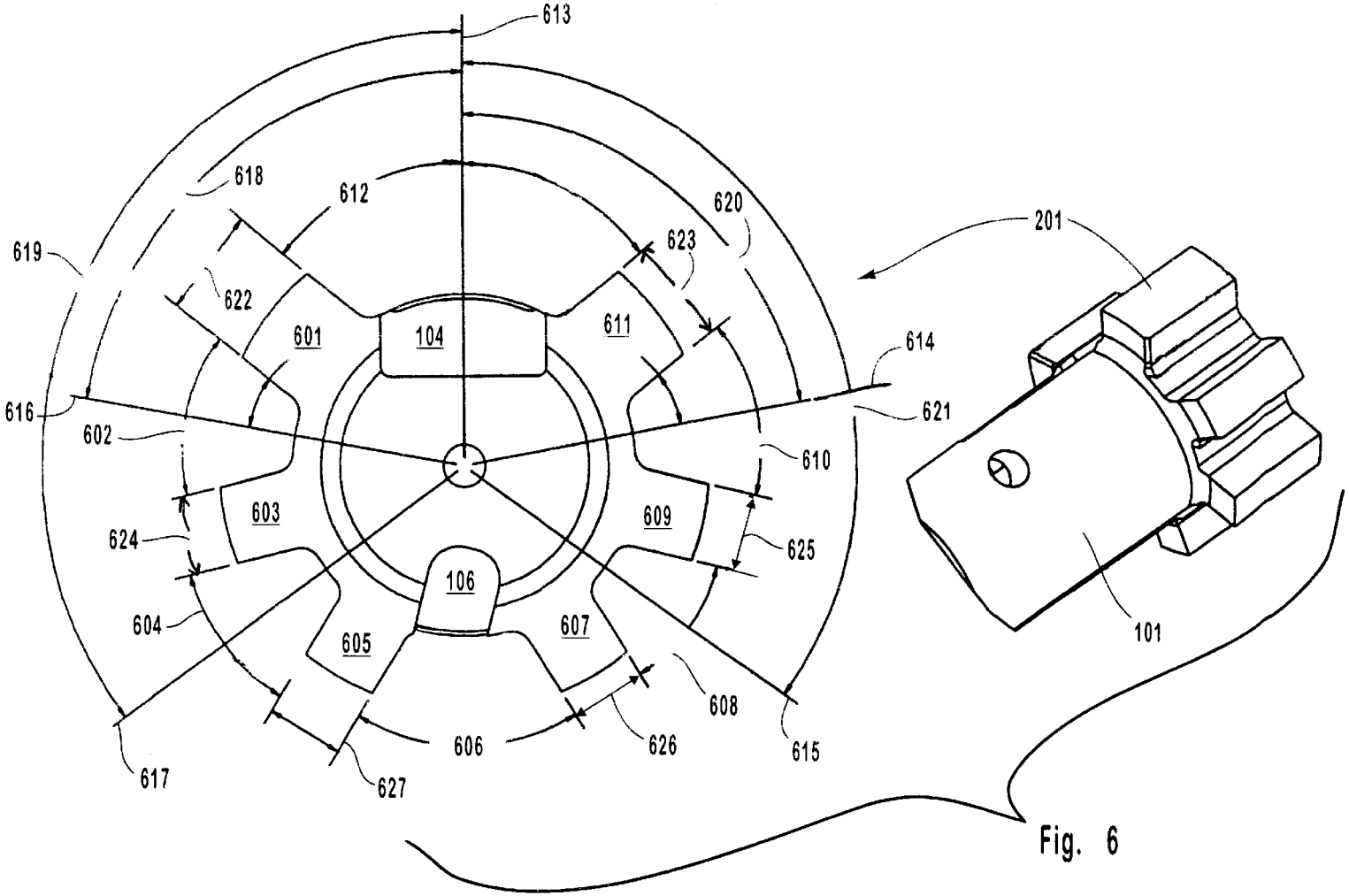
FIG. 6 is a detailed mechanical drawing showing the preferred lug placement and relative sizes of the lugs and gaps of the preferred bolt of this invention.

FIG. 6 shows the detailed mechanical drawing of the bolt head 201 face of the preferred bolt 101 with each lug 601, 603, 605, 607 609 and 61 land lug space 602, 604, 606, 608, 610 and 612 shown. The extractor slot 104 is shown at the top of the bolt head 201 with the ejector slot 106 shown generally at the bottom of the bolt head 201. The relative sizes and positions of the six lugs 601, 603, 605, 607, 609, 611 are important to this invention. For example, the top two lugs 601 and 611 on either side of the extractor slot 104 are generally the same size 622 and 623 and are generally wider than the other lugs 603, 605, 607, 609, each of which is generally the same size 624, 625, 626, 627. In the preferred embodiment of this invention, the bolt head 201 lugs 601, 603, 605, 607, 609, 611 are symmetrically positioned about the axis 613, with the gaps between the respective lugs matched. For example, the preferred gap 602 between the lugs 601 and 603 is generally the same width as the gap 610 between the lugs 609 and 611. The preferred gap 604 between lugs 603 and 605 is generally the same width as the gap 608 between the lugs 607 and 609. The largest gap 612 is between the extractor slot 104 and the second largest gap 606 is over the ejector slot 106. Also, in the preferred embodiment of the bolt head 201 of this invention the distance from axis 613 to point 616 is generally the same as the distance from axis 613 to point 614, and the distance from axis 613 to point 617 is generally the same as the distance from axis 613 to point 615. In this way the design of the preferred bolt head is generally symmetrically. The reader should note that while the ejector slot 106 is shown somewhat closer to lug 605 than lug 607, alternatively, the ejector 106 can be orientated closer to lug 607 or can be positioned at an equal distance from lug 605 and 607.

This bolt head 201 is designed to fit to the barrel extension 701, which has a bolt head cavity 703 having protrusions where the bolt head 201 has lugs and lugs where the bolt head 201 has spaces.

Figure 7:
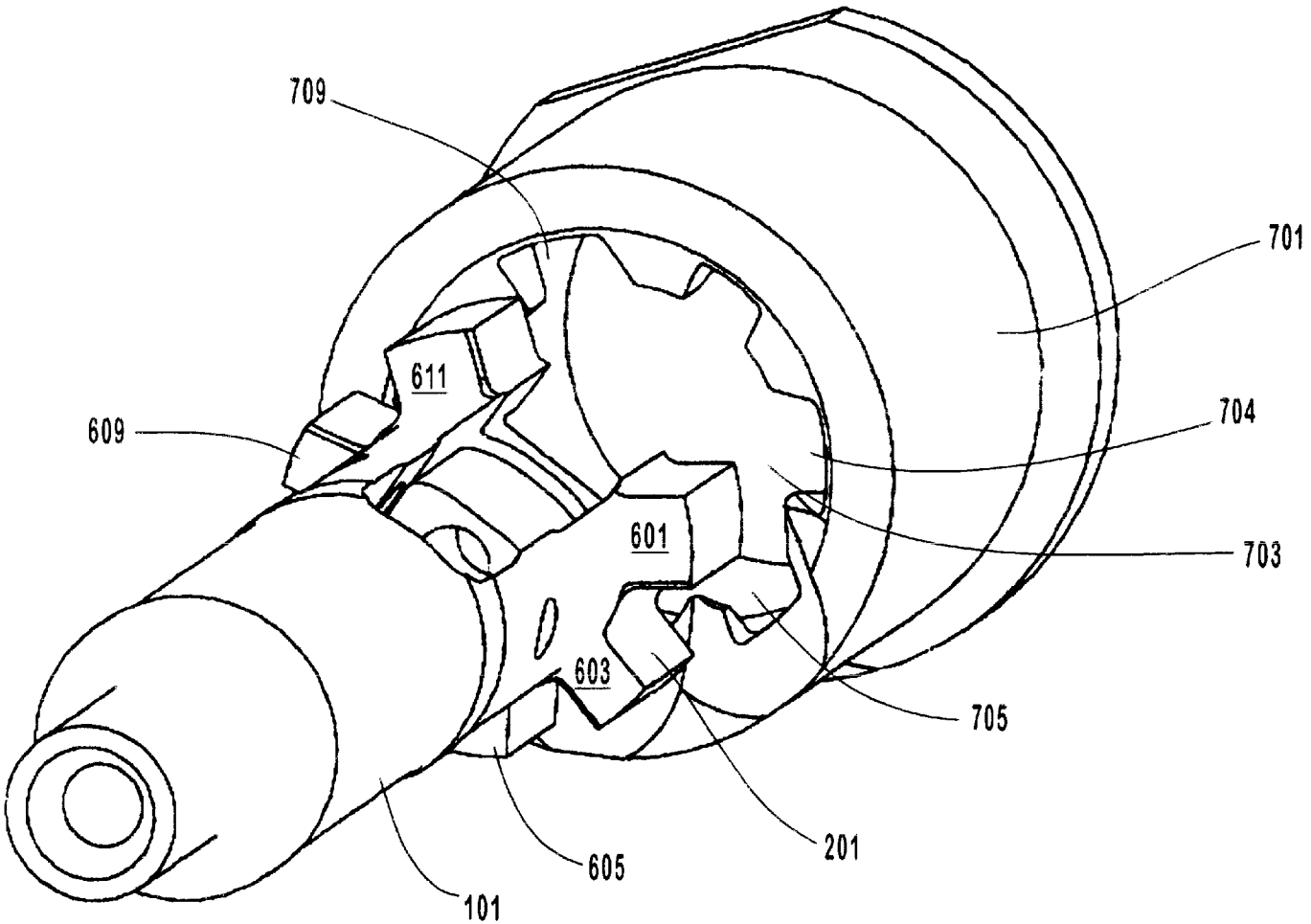
FIG. 7 is a perspective view of the lug mating between the preferred bolt and the barrel extension bolt head cavity of this invention.

FIG. 7 shows a perspective view of the preferred mating between the bolt head 201 and the bolt head cavity 703 of the barrel extension 701, showing how the bolt head 201 lugs 601, 603, 605, 607, 609, 611 mate with bolt head cavity 703 gaps 704, 705, 706, 707,708,709.

Figure 8:
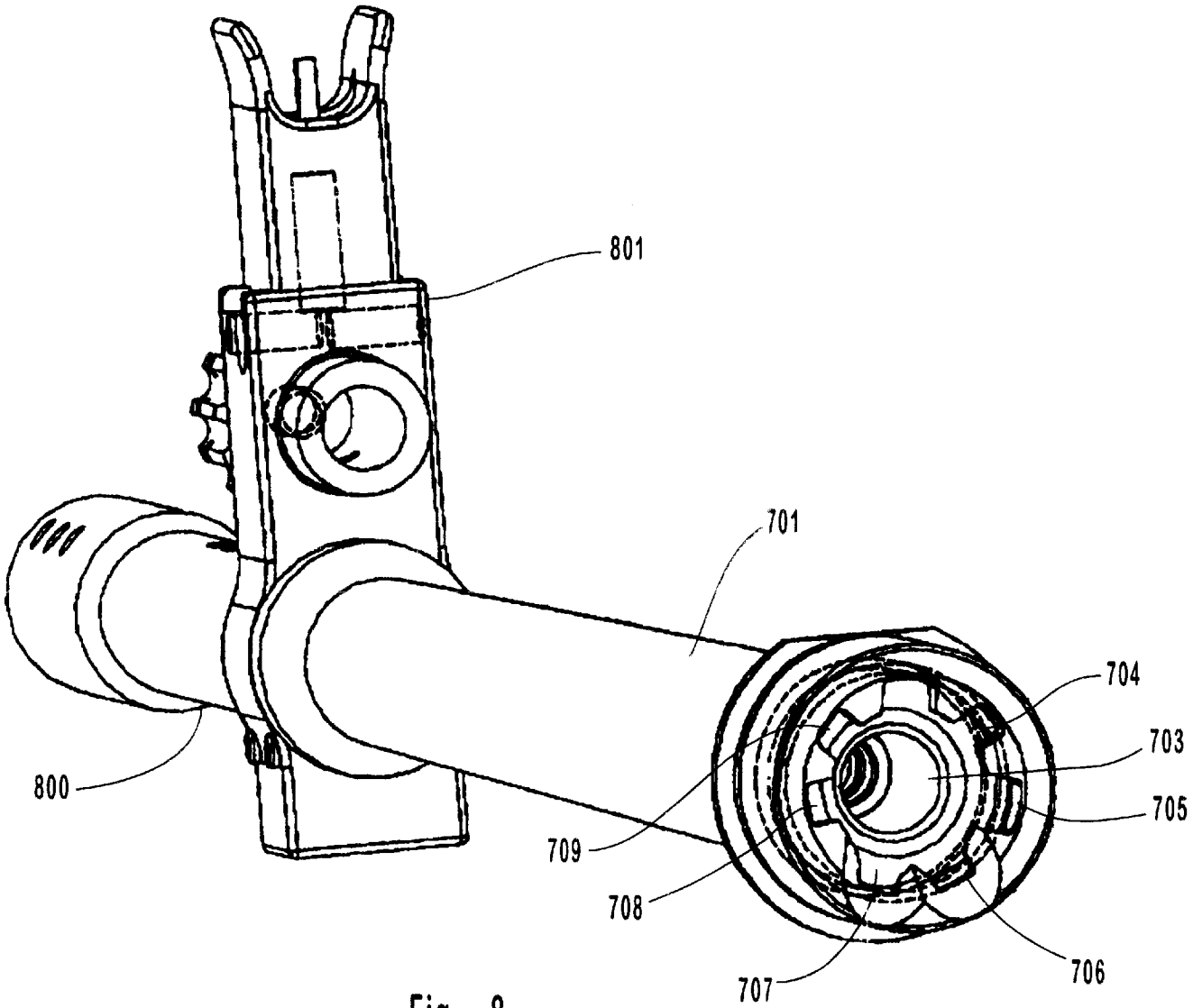
FIG. 8 is a perspective view of the preferred barrel assembly of this invention.

FIG. 8 shows a perspective view of the preferred barrel 800 having a sight 801 attached. Detail of the bolt head cavity 703 with the gaps 704, 705, 706, 707, 708, 709 are shown.

Figure 9:
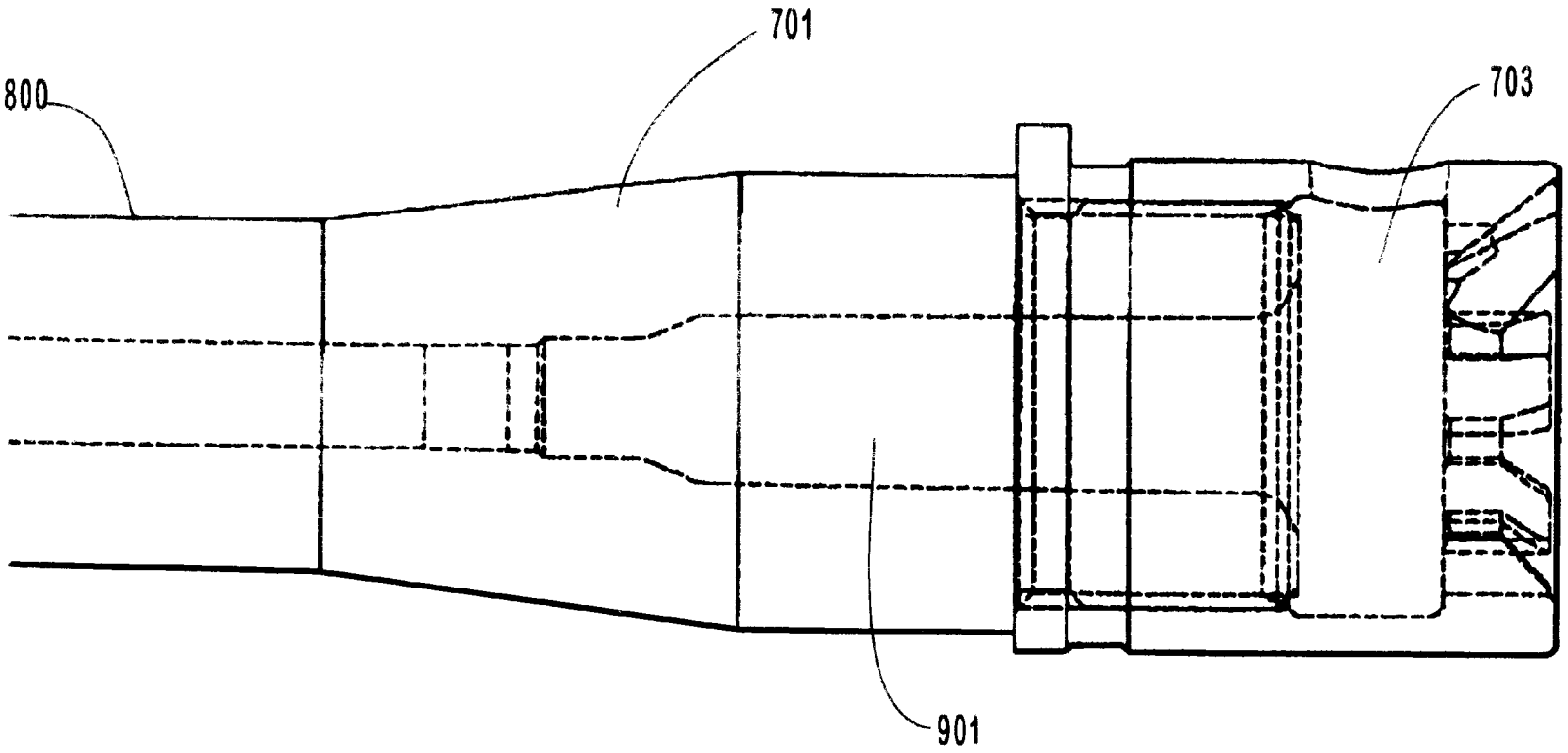
FIG. 9 is a side section view of the bolt head cavity of the preferred barrel of this invention.

FIG. 9 shows a cut-away view of the barrel 800 bolt head cavity 703 showing the chamber 901.

Figure 10:
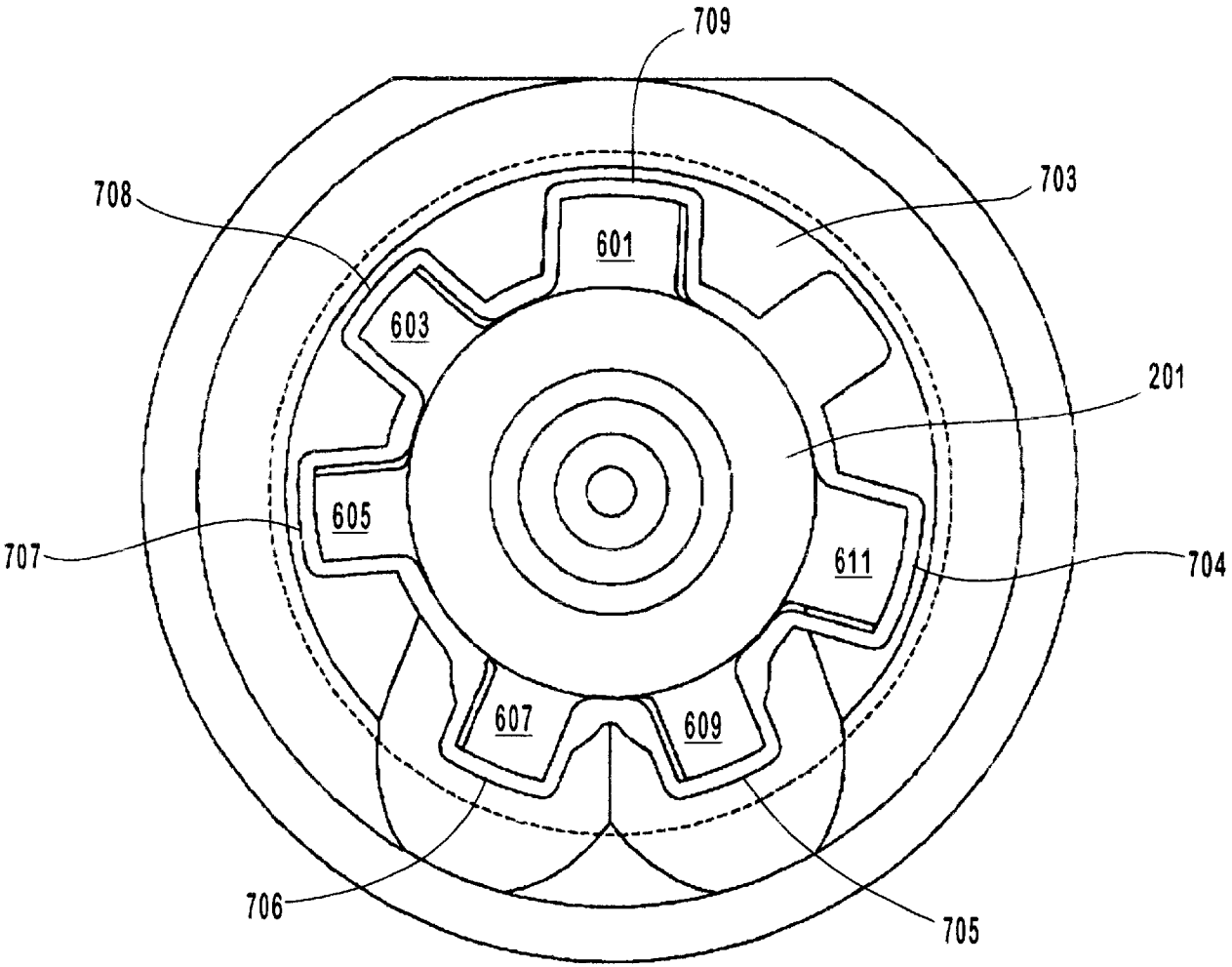
FIG. 10 is an end view of the preferred barrel bolt head—bolt interface of this invention.

FIG. 10 shows an interior cut-away view of the bolt head cavity 703 with the bolt head 201, with the bolt head 201 lugs 601, 603, 605, 607, 609, 611 inserted in the gaps 704, 705, 706, 707, 708, 709 of the bolt head cavity 703.

Figure 11:
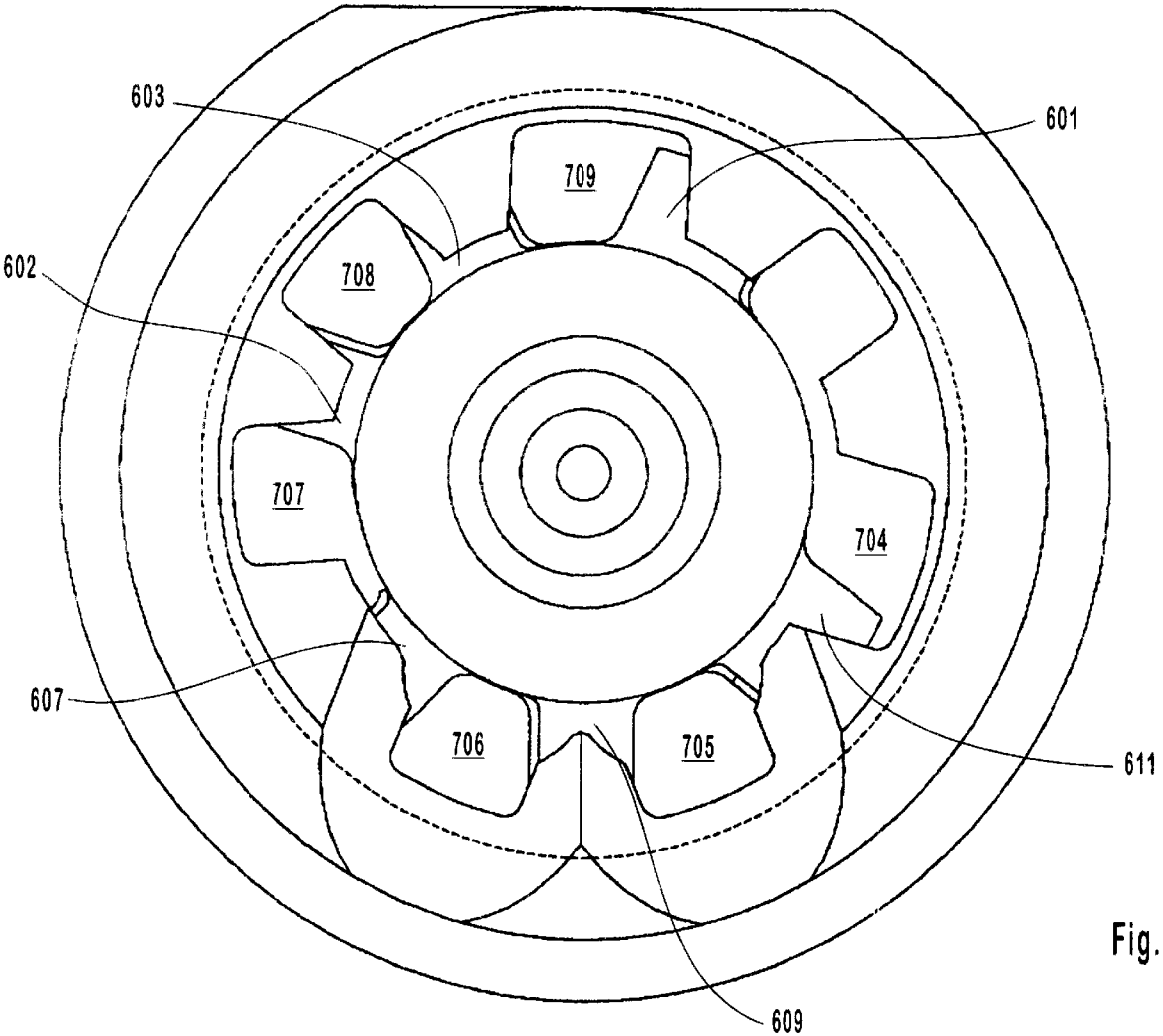
FIG. 11 is an end view of the preferred barrel bolt head—bolt interface of this invention showing the bolt being rotated into engagement.

FIG. 11 shows the interior cut-away view of the bolt head cavity 703 with the bolt head 201 inserted and rotated.

Figure 12:
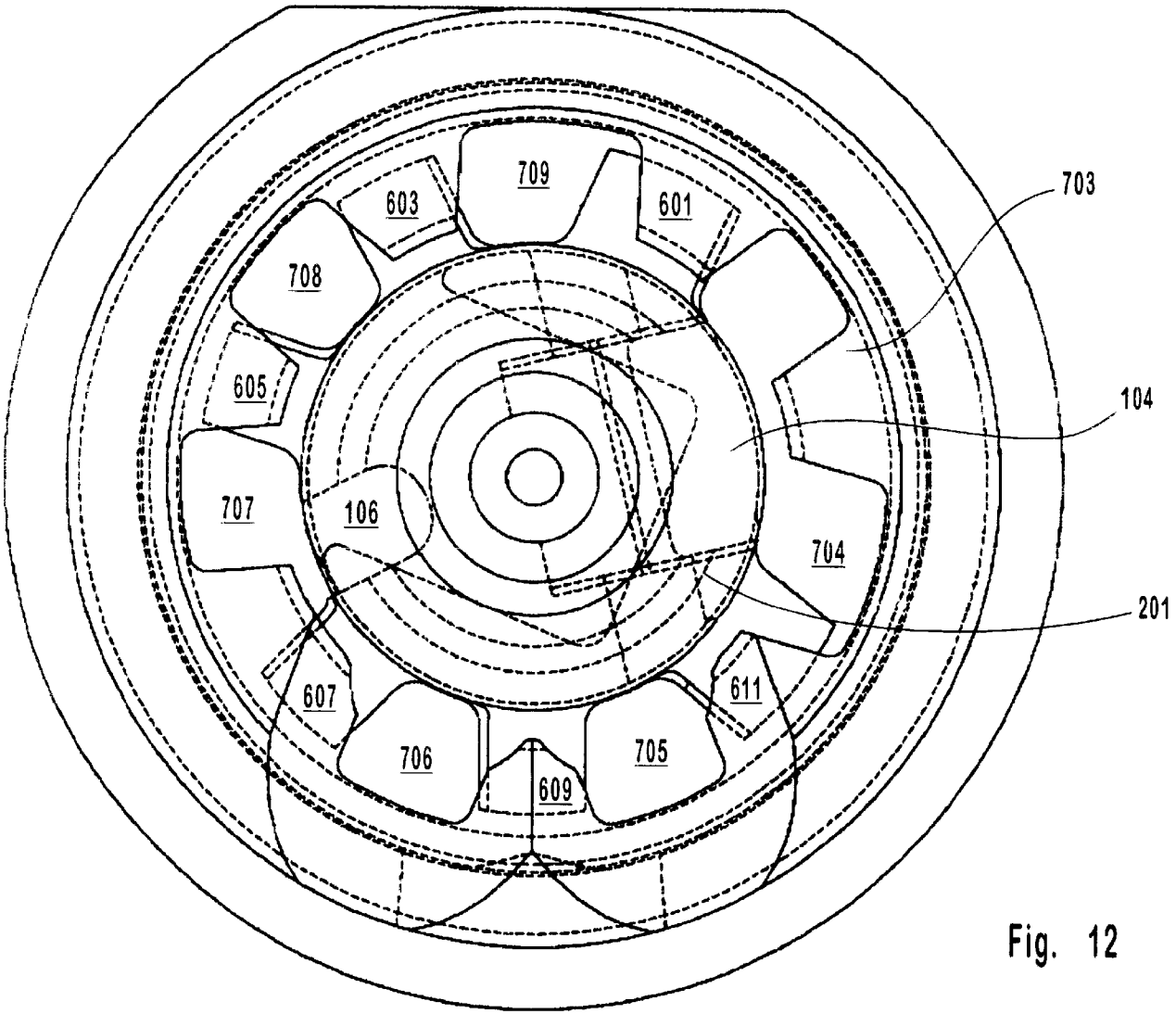
FIG. 12 is an end view of the preferred barrel bolt head—bolt interface showing the lug interaction between the bolt and the bolt head.

FIG. 12 shows the interior cut-away view of the bolt head cavity 703 with the bolt head 201 inserted and rotated as well as showing the relative positions of the extractor 104 and the ejector 106.

The foregoing description is of a preferred embodiment of the invention and has been presented for the purposes of illustration and as a description of the best mode of the invention currently known to the inventors. It is not intended to be exhaustive or to limit the invention to the precise form, connections, or choice of components disclosed. Obvious modifications or variations are possible and foreseeable in light of the above teachings. This embodiment of the invention was chosen and described to provide the best illustration of the principles of the invention and its practical application to thereby enable on of ordinary skill in the art to utilize the invention in various embodiments and with various modifications as are suited to the particular use contemplated. All such modifications and variations are within the scope of the invention as determined by the appended claims when they are interpreted in accordance with the breadth to which they are fairly, legally and equitably entitled.

We claim:

1. A multi-lug bolt, bolt carrier and barrel assembly for rifles, comprising:

(A) a bolt carrier;

(B) a bolt inserted in said bolt carrier, wherein said bolt further comprises a bolt head having an extractor having a center point, an ejector and a plurality of lugs, and wherein said plurality of lugs are six lugs symmetrically located across an axis running perpendicular to said center point of said extractor, and wherein said first lug and said sixth lug are larger than said second, third, fourth and fifth lugs and wherein said first lug and said sixth lug each are adjacent to said extractor;

(C) a barrel adapted to receive said bolt;

(D) an operating rod catch inserted in said bolt carrier;

(E) a cam inserted in said bolt carrier; and (F) a cam slot in said bolt carrier.

2. A multi-lug bolt, bolt carrier and barrel assembly for rifles, as recited in claim 1, wherein said bolt carrier further comprises one or more recesses for receiving a variety of ammunition magazines.

3. A multi-lug bolt, bolt carrier and barrel assembly for rifles, as recited in claim 1, wherein said barrel further comprises a barrel extension having a bolt head cavity and wherein said bolt head cavity further comprises a plurality of gaps adapted to mate with said lugs of said bolt.

4. A multi-lug bolt, bolt carrier and barrel assembly for rifles, comprising:

(A) a bolt carrier;

(B) a bolt inserted in said bolt carrier;

(C) a barrel adapted to receive said bolt, said barrel further comprising a barrel extension having a bolt head cavity, and wherein said bolt head cavity further comprises a plurality of gaps, said plurality of gaps further comprising six gaps wherein said first gap and said sixth gap are larger than said second, third, fourth and fifth gaps;

(D) an operating rod catch inserted in said bolt carrier;

(E) a cam inserted in said bolt carrier; and (F) a cam slot in said bolt carrier.

* * * * *